United States Patent [19]

Sheasby et al.

[11] 4,251,330

[45] Feb. 17, 1981

[54] ELECTROLYTIC COLORING OF ANODIZED ALUMINIUM BY MEANS OF OPTICAL INTERFERENCE EFFECTS

[75] Inventors: Peter G. Sheasby, Bloxham; Edward P. Short, North Aston, both of England; Tarun K. S. Gupta, Maharahstra, India

[73] Assignee: Alcan Research and Development Limited, Montreal, Canada

[21] Appl. No.: 3,892

[22] Filed: Jan. 16, 1979

[30] Foreign Application Priority Data

Jan. 17, 1978 [GB] United Kingdom ..... 1874/78

[51] Int. Cl.[3] ..... C25D 11/12; C25D 11/22

[52] U.S. Cl. ..... 204/35 N; 204/58

[58] Field of Search ..... 204/35 N, 42, 58, 38 A

[56] References Cited

U.S. PATENT DOCUMENTS

| | | | |
|---|---|---|---|
| 3,634,208 | 1/1972 | Kuroda | 204/35 N |
| 3,717,555 | 2/1973 | Chakravarti et al. | 204/35 N |
| 3,787,295 | 1/1974 | Endinger et al. | 204/35 N |
| 3,798,137 | 3/1974 | Kampert et al. | 204/35 N |
| 3,915,813 | 10/1975 | Abe et al. | 204/35 N |
| 4,042,468 | 8/1977 | Hasegawa et al. | 204/42 |
| 4,043,880 | 8/1977 | Yanagida et al. | 204/35 N |
| 4,066,516 | 1/1978 | Sato | 204/15 |
| 4,066,816 | 1/1978 | Sheasby et al. | 428/336 |

OTHER PUBLICATIONS

W. Hübner and D. Schiltknecht, The Practical Anodising of Aluminum, MacDonald & Evans, London, 1960, pp. 24–25.

*Primary Examiner*—G. L. Kaplan
*Assistant Examiner*—William Leader
*Attorney, Agent, or Firm*—Cooper, Dunham, Clark, Griffin & Moran

[57] ABSTRACT

In a process for the electrocoloring of anodized aluminium in which colors are obtained by interference effects the pores of an anodic oxide film, produced by D.C. anodizing in sulphuric acid, are enlarged by electrolytic treatment in an acid electrolyte having a high dissolving power for aluminium oxide under alternating current conditions.

14 Claims, No Drawings

ELECTROLYTIC COLORING OF ANODIZED ALUMINIUM BY MEANS OF OPTICAL INTERFERENCE EFFECTS

BACKGROUND OF THE INVENTION

1. Field of the Invention

The present invention relates to the production of anodic oxide films on aluminium (including aluminium alloys), which are perceived by the viewer as coloured due to optical interference effects within the film.

2. Prior Art

The colouring of anodic oxide films by electrolytic deposition of inorganic particles has become well known. In the electrocolouring process inorganic material is deposited in the pores of the anodic oxide film by the passage of electric current, usually alternating current, between an anodised aluminium surface and a counterelectrode, whilst immersed in an acidic bath of an appropriate metal salt. The most commonly employed electrolytes are salts of nickel, cobalt, tin and copper. The counterelectrode is usually graphite or stainless steel, although nickel, tin and copper electrodes are also employed when the bath contains the salt of the corresponding metal. The deposits of material constitute what are referred to herein as inorganic pigmentary deposits, although the mechanism by which they function to give a coloured appearance is quite different from that of normal organic or inorganic pigments.

In a conventional electrocolouring process, employing, for example, a nickel sulphate electrolyte, the colours obtained range from golden brown through dark bronze to black with increase in treatment time and applied voltage. It is believed that in the conventional coloured anodic oxide coatings the dark colours are the result of the scattering and absorption within the coating of the light reflected from the surface of the underlying aluminium metal. The gold to bronze colours are believed to be due to greater absorption of the shorter wave length light, i.e. in the blue-violet range. As the pores of the oxide film become increasingly filled with pigmentary deposits the extent of the absorption of light within the film becomes almost total, so that the film acquires an almost completely black appearance.

In current commercial practice anodising in a sulphuric acid-based electrolyte has almost totally replaced all other anodising processes for the production of thick, clear, porous-type anodic oxide coatings. In general, direct current voltages in the range of 12–22 volts are used in sulphuric acid-based electrolytes depending upon the strength and temperature of the acid. Sulphuric acid-based electrolytes include mixtures of sulphuric acid with other acids, such as oxalic acid and sulphamic acid, in which the anodising characteristics are broadly determined by the sulphuric acid content. Typically in sulphuric acid anodising the electrolyte contains 15–20% (by weight) sulphuric acid at a temperature of 20° C. and a voltage of 17–18 volts is employed.

It has been shown (G. C. Wood and J. P. O'Sullivan: Electrochimica Acta 15 1865–76 (1970) that in a porous-type anodic aluminium oxide film the pores are at essentially uniform spacing so that each pore may be considered as the centre of an essentially hexagonal cell. There is a barrier layer of aluminium oxide between the bottom of the pore and the surface of the metal. The pore diameter, cell size and barrier layer thickness each have a virtually linear relationship with the applied anodising voltage. This relationship holds true within quite small deviations for other electrolytes employed in anodising aluminium, for example chromic acid and oxidic acid.

In normal sulphuric acid anodising, the pore diameter is in the range of 150–180 Å (15–18 nm) and the applied voltage is 17–18 volts. The barrier layer thickness is about equal to the pore diameter and the cell size is about 400–500 Å (40–50 nm). The same holds true with mixed sulphuric acid-oxalic acid electrolytes.

U.S. Pat. No. 4,066,816 describes a process in which a new range of colours was obtained by electrocolouring, the apparent colour being due to optical interference in addition to the scattering and absorption effects already noted. In order to obtain these optical interference colours it was found necessary to increase the cross section of the pores of a sulphuric acid-anodised film in a region adjacent the aluminium oxide/aluminium interface so as to increase the size of the outer ends of the pigmentary deposits. Without that essential step it was found impossible to obtain satisfactory colours by light interference effects in such film.

Since the perceived colour is the result of interference between light scattered from the outer ends of the individual deposits and light scattered from the aluminium/aluminium oxide interface the outer ends of the individual deposits must be of adequate size and when reference is made to the size of the deposits, it is the size of the outer ends which is relevant in this context. The colour produced depends on the difference in optical path resulting from separation of the two light scattering surfaces (the outer ends of the deposits and the aluminium oxide/aluminium interface). To produce perceived colours by interference this separation should be at least 50 nm; as stated in the aforementioned U.S. Pat. No. 4,066,816, this separation should be in the range of 500–3000 A (50–300 nm). The separation, when colouring a particular film, depended on the height of the deposits. It was found that a range of attractive colours, including blue-grey, yellow-green, orange-brown and purple, can be produced by electrolytic colouring when employing interference colouring effects.

In Journal of Japanese Anodising Association (Aluminium Kenkyu Kaisha) 1976 No. 2 pp 17–18, I. Inoue and others have described a modification of the conventional electrocolouring process devised by Asada in which an anodic oxide film is produced by anodising in sulphuric acid under D.C. followed by electrocolouring under A.C. conditions. Inoue and his co-workers found that blue, violet and green shades could be obtained by adding phosphoric acid to the ordinary colouring electrolyte. They found that they could also obtain the same colours by treating the D.C.-anodised material in phosphoric acid under A.C. conditions before carrying out the electrocolouring treatment. They further found that these colours could be obtained by carrying out the anodising at low A.C. voltage in phosphoric acid in place of conventional D.C. anodising in sulphuric acid before the electrocolouring step. The authors concluded that the colours were due to geometrical change of the barrier layer as a result of the addition of phosphoric acid with resultant dispersed deposition of metals in the electrocolouring stage giving rise to blue, violet or green colouring of the film.

In U.S. Pat. No. 4,066,816 one described route for increasing the size of the relevant portion of the pores was the passage of direct current between the aluminium article, connected as anode, and a counter electrode in a phosphoric acid-based electrolyte at voltages in the range of 8–50 volts.

SUMMARY OF THE INVENTION

The invention will be described as embodied in a process for the production of an anodised aluminium article coloured by virtue of optical interference, comprising the steps of establishing on the aluminium surface a porous anodic film having a thickness of at least 3 microns and enlarging the pores in the film such that upon electrolytically depositing an inorganic material in the enlarged pores the average size of the upper surface of the individual deposits of the deposited material is at least 26 nm and such upper surface is at least about 50 nm from the interface formed by the aluminium surface and the anodic oxide film.

We have now found surprisingly that brighter and more intense colours can be produced if the electrolytic treatment is carried out at least in part under alternating current conditions in an acid medium having a strong dissolving power for aluminium oxide. The dissolving power of an acid for aluminium oxide is dependent upon temperature as well as the composition and concentration of the acid. A phosphoric acid-based electrolyte at temperatures up to, but not greatly exceeding 25° C. is preferred for this purpose, but other acids or acid mixtures, such as a mixture of sulphuric acid and chromic acid suggest themselves for this purpose when used at concentrations and temperatures at which their dissolving power is similar to that of a phosphoric acid electrolyte at ambient temperature. Other possible acids are oxalic acid for example used at high temperature and dilute sulphuric acid in the presence of an additive used to destroy any hydrogen sulphide generated when anodising with sulphuric acid under A.C. conditions. The explanation for the difference achieved in a phosphoric acid medium when an A.C. treatment is employed in place of D.C. is not yet fully understood but it appears probable that a greater proportion of the original pores are modified in the course of the phosphoric acid treatment under alternating current conditions. There appears to be a tendency in the electrocolouring stage for the unmodified pores to receive the relatively small and relatively deep deposits of the conventional electrocolouring process. The perceived colour is then due to the combination of the light interference effects due to the large, shallow deposits in the modified pores and the light absorption effects due primarily to the much deeper small deposits in the unmodified pores. The light absorption effects due to the deep small deposits impart a certain "muddiness" (bronze overtone) to the perceived colour of the film. Where a significant decrease of the proportion of unmodified pores can be achieved the light absorption effects should be significantly decreased and the colour effects due to light interference predominate.

Usually the whole treatment in the phosphoric acid-based electrolyte is performed under A.C. conditions, but in some circumstances a short preliminary D.C. treatment can be employed with advantage. Modification of the pores under A.C. conditions can be performed in a phosphoric acid-based electrolyte which also contains salts of one or more metals, such as tin, nickel or copper, from which deposits are formed during the course of the A.C. treatment. In such a situation a preliminary D.C. treatment enables pore enlargement to commence without simultaneous formation of deposits (the aluminium being anodic in the D.C. stage). Pore enlargement continues simultaneously with deposition as soon as A.C. treatment is commenced. However A.C. conditions can be continued throughout the treatment.

Where the electrolyte is substantially free of metal salts, which can form pigmentary deposits under A.C. conditions, a short anodic D.C. treatment can be employed after the A.C. treatment to slightly thicken the barrier layer of the anodic oxide film to reduce the current density in the subsequent colouring stage. This D.C. treatment should be only continued for a short time (about ½–3 minutes) because it results in progressive loss of the advantages obtained by A.C. treatment. Such a final D.C. treatment should not be used where deposition has been performed simultaneously with pore enlargement under A.C. conditions because it will cause redissolution of the deposits. The pore size should be enlarged to an average size of at least 26 nm at the base region of the pores and preferably to an average size of at least 30 nm.

As already stated the reason for the improvement obtained by the use of A.C. in place of D.C., at least in part, in the field-assisted pore enlargement treatment is not fully understood. It does appear possible that a more even pore enlargement is achieved by the cyclic change from field-assisted dissolution during one half of the A.C. cycle to straight chemical dissolution in the other half cycle so that the A.C. acts as interrupted D.C.

In carrying out the pore modification treatment with phosphoric acid the applied A.C. voltage is preferably in the range of 5–40 volts and the electrolyte temperature is preferably in the range of about 15° C. to about 25° C. The phosphoric acid is preferably at a strength of about 50 gms/liter to about 150 gms/liter in the electrolyte employed in the pore modification treatment but it is possible to employ an electrolyte of somewhat greater or somewhat lesser strength without severe disadvantage. It will be understood that the phosphoric acid electrolyte may include a proportion of one or more other anodising acids, such as sulphuric acid, oxalic acid, sulphosalicylic acid, sulphamic acid and tartaric acid, which will to some extent modify the action of the phosphoric acid. To obtain the same results with a mixed acid electrolyte operating parameters are changed as compared with an electrolyte containing only phosphoric acid. For most satisfactory results we prefer to use an A.C. voltage of 8–16 volts with a phosphoric acid electrolyte, since the resulting film is more satisfactory in the subsequent electrocolouring stage.

In carrying out the A.C. pore modification treatment in a phosphoric acid electrolyte we have observed that the current initially increases to a maximum value, remains at or about the maximum value for up to about 5 minutes and then commences to decline. We have found that the best results are obtained by continuing the treatment at least until the maximum current value is achieved and terminating the treatment before the onset of the decline. In practice a continuation of the treatment for 3–4 minutes after the current has stabilised at an approximate maximum value gives satisfactory results under the preferred conditions of temperature and phosphoric acid concentration already stated.

The invention is hereafter further described with reference to the accompanying examples in which the pore enlargement treatment is carried out, at least in part, under A.C. conditions. The use of A.C. in the pore enlargement treatment of the anodised aluminium apparently allows the treatment time to be shortened. This is advantageous because it reduces the time in which the bulk of the anodised oxide film is subject to direct chemical attack by the acid and there is consequently less risk of the film becoming crumbly.

The colours in each of the following Examples 1, 2, 4 and 5 were found to be stronger and with less muddy overtones than would have been obtained where pore enlargement is carried out in a phosphoric acid-based electrolyte under D.C. conditions alone as in Example 3.

EXAMPLE 1

An extrusion, 75 mm × 75 mm in size, of an aluminium magnesium silicide alloy of the AA6063 type was degreased in an inhibited alkaline cleaner, etched for 10 minutes in a 10% sodium hydroxide solution at 60° C., desmutted in accordance with normal procedure, and then anodised under direct current at 17 volts in a 165 g/l sulphuric acid electrolyte for 30 minutes at a temperature of 20° C. and a current density of 1.5 A/dm$^2$ to give an anodic oxide film thickness of about 15 microns.

It was then treated in 100 g/liter phosphoric acid at 20° C. for 4 minutes using an A.C. voltage of 10 V. It was then transferred for colouring in an electrolyte containing:

100 g/liter nickel sulphamate
40 g/liter boric acid
200 g/liter magnesium sulphate
pH 5.6
Temperature 24° C.

An A.C. colouring voltage of 11.5 V was used for times between 2 and 8 minutes with graphite counter-electrodes. The colours obtained were as follows:

2 minutes—bronze
3.5 minutes—dark blue purple
5 minutes—medium blue green
6.5 minutes—green blue
8 minutes—green bronze

EXAMPLE 2

An $AlMg_2Si$ sample was anodised in sulphuric acid as in Example 1. It was then subjected to pore enlargement in a phosphoric acid electrolyte containing 100 g/liter phosphoric acid and held at 20° C. In this bath the sample was given 4 minutes at 10 volts A.C. followed by ½ minute at 20 volts D.C. to thicken the barrier layer. It was again coloured at 11.5 V A.C. in the nickel bath of Example 1 at pH 5.6 for times of 2 to 8 minutes. The colours obtained were as follows:

2 minutes—bronze
3.5 minutes—dark purple blue
5 minutes—dark blue
6.5 minutes—medium blue green
8 minutes—green blue The colours obtained on this sample were very similar to those produced with Example 1 but the colouring rate was slightly slower because of the final short D.C. treatment at higher voltage to thicken the barrier layer.

EXAMPLE 3

An $AlMg_2Si$ sample was anodised as in Example 1. For contrast with Example 2, the present sample was subjected only to D.C. in the phosphoric acid treatment stage in which D.C. was applied for 6 minutes at 10 volts followed by ½ minute at 20 volts. As before it was coloured for 2 to 8 minutes at 11.5 volts A.C. in the nickel bath of Example 1 at pH 5.6. The colours obtained were as follows:

2 minutes—bronze purple
3.5 minutes—grey blue
5 minutes—green bronze
6.5 minutes—yellow bronze
8 minutes—bronze This sample illustrates the more bronze colours obtained by using D.C. throughout the phosphoric acid pore-enlargement treatment stage rather than A.C. It also shows how longer treatment times in the phosphoric acid stage are required and the rapid change to bronze colours during colouring shows that pore modification was not as extensive as with Examples 1 and 2.

EXAMPLE 4

An $AlMg_2Si$ sample was anodised as in Example 1 and then treated in 100 g/liter phosphoric acid for 4 minutes at 10 volts A.C. at 23° C. It was coloured in an electrolyte containing:

50 g/liter nickel sulphamate
150 g/liter magnesium sulphate
pH 1.5 (adjusted by addition of $H_2SO_4$)
Temperature 23° C.

An A.C. colouring voltage of 15 V was used for times of 1 to 15 minutes and the following colours were obtained:

1 minute—light bronze purple
2 minutes—light purple
3 minutes—medium blue purple
4 minutes—medium blue
5 minutes—medium blue In this Example and in the following Example 5 the sample was dipped in a chromate fixing bath at the end of the colouring treatment to reduce change in colour due to attack on the deposits by acid residues in the pores.

EXAMPLE 5

An $AlMg_2Si$ sample was sulphuric acid anodised as in Example 1 and then treated in 100 g/liter phosphoric acid at 19° C. for 4 minutes at 10 volts A.C. It was then coloured in an electrolyte containing the following:

100 g/liter cobalt sulphate
40 g/liter boric acid
150 g/liter magnesium sulphate
pH 4.4
Temperature 16° C.

An A.C. colouring voltage of 9.5 V was used for times of 1 to 3 minutes and the following colours were obtained:

1 minute—purple bronze
1.5 minutes—purple blue
2 minutes—dark blue
2.5 minutes—medium blue
3 minutes—green bronze

EXAMPLE 6

An $AlMg_2Si$ sample was anodised as in Example 1. It was then treated in an electrolyte which contained 105 g/liter $H_3PO_4$ and 1 g/liter stannous sulphate at 23° C. The sample was treated for 4 minutes at 20 volts D.C. and then for 4 minutes at 10 volts A.C. When the sample was removed from the phosphoric acid-tin bath the colour was pale yellow. It was rinsed and then coloured at ambient temperature in an acidic nickel-based bath of the following compositions:

50 g/liter nickel sulphamate 150 g/liter magnesium sulphate
Sulphuric acid to give pH of 1.5
Stainless steel counterelectrodes.

Alternating current was used at 10 volts for times of 2 to 8 minutes. The colours obtained were as follows:

2 minutes—purple brown
4 minutes—purple blue
6 minutes—blue purple
8 minutes—blue

EXAMPLE 7

An $AlMg_2Si$ sample was anodised in sulphuric acid as in Example 1. It was then treated in the phosphoric acid-tin bath of Example 6, using A.C. treatment only for 4 minutes at 10 volts. It was then coloured in the 50 g/liter nickel sulphamate bath of Example 6 at 10 volts A.C. for times of 2 to 10 minutes. The colours obtained were as follows:

2 minutes—brown
4 minutes—purple brown
6 minutes—purple blue
8 minutes—blue purple
10 minutes—blue

EXAMPLE 8

An $AlMg_2Si$ sample was anodised in sulphuric acid as in Example 1 and then treated in a 100 g/liter phosphoric acid electrolyte at 20° C. for 4 minutes using an A.C. voltage of 10 volts. It was coloured in an electrolyte containing 7.5 g/liter stannous sulphate and 80 g/liter aluminium sulphate adjusted to pH 2.0 by the addition of sulphuric acid at a temperature of 19° C. An A.C. colouring voltage of 10 volts was used for times of 15 to 90 seconds. The colours obtained were as follows:

15 seconds—reddish bronze
30 seconds—grey blue
45 seconds—grey green
60 seconds—orange yellow
90 seconds—reddish brown These results illustrate the very high deposition rates obtained with tin. In practice it would be preferred to use a lower voltage to slow down the rate of change of colour.

EXAMPLE 9

An $AlMg_2Si$ sample was anodised in sulphuric acid as in Example 1 and then treated in 100 g/liter phosphoric acid for 4 minutes at 10 volts A.C. It was then coloured in a bath containing 5 g/liter cupric sulphate and 25 g/liter magnesium sulphate at pH 1.1 (sulphuric acid added) and at a temperature of 20° C. A colouring voltage of 20 volts A.C. was used for times of 1 to 7 minutes. The colours obtained were as follows:

1 minute—purple blue
2 minutes—blue green
3 minutes—yellow
4 minutes—orange red
5 minutes—red purple
6 minutes—violet green
7 minutes—green These colours were different from those obtained with solutions of other metal salts quoted in earlier Examples and were deep, relatively pure colours.

EXAMPLE 10

An $AlMg_2Si$ sample was anodised as in Example 1 and then treated in 100 g/liter phosphoric acid at 22° C. for 4 minutes at 10 volts A.C. It was then coloured in a bath containing the following:

1 g/liter copper sulphate
50 g/liter nickel sulphamate
150 g/liter magnesium sulphate
pH 1.5 (adjusted by addition of $H_2SO_4$)
Temperature 21° C.

An A.C. colouring voltage of 15 volts was used for times of 2 to 6 minutes and the following colours were obtained:

2 minutes—bronze purple
3 minutes—purple brown
4 minutes—dark purple blue
5 minutes—medium blue

EXAMPLE 11

An $AlMg_2Si$ sample was anodised as in Example 1 and then treated in a bath containing 100 g/liter phosphoric acid and 1 g/liter cupric sulphate at 20° C. for 4 minutes at 10 volts A.C. It was then transferred to a colouring bath containing the following:

50 g/liter nickel sulphamate
150 g/liter magnesium sulphate
pH 1.5 (adjusted with $H_2SO_4$)
Temperature 24° C.

An A.C. colouring voltage of 20 volts was used for times of 2 to 5 minutes and the following colours were obtained:

2 minutes—medium purple blue
3 minutes—blue purple
4 minutes—medium blue
5 minutes—medium blue One difficulty that has been experienced in the commercial development of colouring anodic oxide films by means of light interference effects is change in colour between the end of the electrocolouring stage and the final sealing stage. This change is believed to be the result of slight redissolution of the deposited pigmentary material by the acid electrolyte remaining in the pores. This has the effect of reducing the separation between the outer ends of the pigmentary deposits and the oxide/aluminium interface. This difficulty can be largely overcome by immediately dipping the work in a fixative, such as a chromate bath, but that expedient is generally inconvenient in a commercial operation by reason of the possibility of delay between the electrocolouring operation and the subsequent fixative dip. Such a delay could occur, for example, by the temporary non-availability of overhead lifting gear, employed for the transfer of work between operating stages of the process.

We have now found that a very significant improvement in the production of anodised aluminium, coloured by light interference effects, can be achieved by depositing acid-resistant material to form the pigmentary deposits in the pores of the anodic oxide film in the electrocolouring stage. In most instances such deposits are formed by very intimate co-deposition of two metals, which are known to form acid-resistant alloys. Where the deposits consist (or consist largely of) an acid-resistant material there is little change in colour between the completion of the electrolytic colouring stage and the subsequent washing stage in which acid is removed from the pores.

It is of course well known that certain eutectic alloys such as Sn-Ni and Cu-Ni are very resistant to attack by strong acid. It is possible to deposit acid-resistant deposits from a colouring bath containing salts of the two metals. It is also possible for one metal, for example Sn, to be deposited in the pores in a first treatment stage and the second metal, for example Ni, to be contained in the electrolyte of a subsequent electrolyte treatment stage. It appears that in the subsequent A.C. colouring treatment with a Ni electrolyte, the already deposited Sn in the pores redissolves during one half of the A.C. cycle and redeposits with Ni during the other half cycle to form acid-resistant Sn-Ni deposits in the pores. While most experimental work has so far been carried out on the deposition of Sn-Ni and Cu-Ni, available knowledge of the acid resistance of alloys of metals which can be deposited in this type of electrolytic treatment, suggests that deposition of pigmentary material containing Cu-Co, Cu-Mn, Mn-Ni and Mn-Co alloy phases will lead to similar satisfactory results.

As will readily be understood from the foregoing explanation, the deposition of at least one metallic component of acid-resistant co-deposits can be introduced into the pores in the same treatment bath as is employed to effect pore enlargement under A.C. conditions.

The deposits formed in Examples 6, 7, 10 and 11 are co-deposits of the type under consideration.

Examination of deposits resulting from the deposition of Sn and Ni on the one hand and Cu and Ni on the other hand by means of E.S.C.A. equipment (electron spectroscopy for chemical analysis) indicates that the deposits are either alloys or such intimate mixtures of the metals that they may be expected to act chemically as an alloy of the same proportionate composition. In consequences, where the deposits have the chemical composition of an acid-resistant alloy it is not found necessary to employ a fixative, such as a chromate bath, to prevent colour change.

We claim:

1. In a process for the production of an anodised aluminium article colored by virtue of optical interference, comprising the steps of establishing on the aluminium surface a porous anodic film having a thickness of at least 3 microns and enlarging the pores in the film such that upon electrolytically depositing an inorganic material in the enlarged pores the average size of the upper surface of the individual deposits of the deposited material is at least 26 nm and such upper surface is between 50 nm and 300 nm from the interface formed by the aluminium surface and the anodic oxide film, the improvement which comprises:

in the pore-enlarging step, enlarging the pores particularly toward their lower ends in the presence of an acid electrolyte, characterised by its strong dissolving power for aluminium oxide, and a pore enlarging alternating current passing between said aluminium article and a counter electrode.

2. The process of claim 1 wherein the acid electrolyte is a phosphoric acid-based electrolyte.

3. The process of claim 2 wherein the alternating current is applied at from about 5 to about 40 volts.

4. The process of claim 2 wherein the phosphoric acid concentration is from about 50 to about 150 grams/liter.

5. The process of claim 4 wherein the temperature of the acid electrolyte is from about 15° C. to about 25° C.

6. The process of claim 5 wherein the alternating current is applied at from about 8 to about 16 volts.

7. The process of claim 6 wherein the application of alternating current is discontinued prior to decline of an attained maximum current value.

8. The process of claim 1 wherein the acid electrolyte contains salts of one or more metals capable of forming an inorganic material which is simultaneously deposited in the pores with the enlargement of the pores, at their base region, to an average size of at least about 26 nm at the upper surface of the deposit.

9. The process of claim 8 wherein the aluminium article is subjected to an anodic D.C. treatment in said acid electrolyte before commencement of passage of A.C. in said electrolyte.

10. The process of claim 1 in which said acid electrolyte is substantially free of metal salts which can form pigmentary deposits under A.C. conditions wherein the aluminium article is subjected to an anodic D.C. treatment for ½–3 minutes subsequent to pore enlargement under A.C. conditions but preceding subsequent deposition of inorganic material under A.C. conditions.

11. The process of claim 8 in which the aluminium article is subsequently subjected to deposition of inorganic material under A.C. conditions in a second acidic electrolyte containing the salt of another metal, said first acidic electrolyte and said second electrolyte respectively containing metal salts of metals which form an acid resistant alloy when co-deposited.

12. The process of claim 11 in which the eventual deposits in the pores of said anodised aluminium article are comprised of a codeposit selected from the group Sn-Ni, Cu-Ni, Cu-Co, Cu-Mn, Mn-Ni and Mn-Co.

13. A method for the production of an anodised aluminium article coloured by virtue of optical interference, comprising the steps of establishing a porous anodic film on the aluminium surface having a thickness of at least 3 microns enlarging the pores in the film particularly toward their lower ends in the presence of an acid electrolyte, characterised by its strong dissolving power for aluminium oxide, and an alternating current to a size such that upon electrolytically depositing an inorganic material in the enlarged pores the average size of the upper surface of the deposited material is at least 26 nm and electrolytically depositing an inorganic material in the enlarged pores such that the upper surface of said deposit is between 50 nm and 300 nm from the interface formed by the aluminium surface and the anodic oxide film.

14. The process of claim 13 in which the inorganic material deposited in said enlarged pores is an acid resistant codeposit selected from the group Sn-Ni, Cu-Ni, Cu-Co, Cu-Mn, Mn-Ni and Mn-Co.

* * * * *

UNITED STATES PATENT AND TRADEMARK OFFICE

CERTIFICATE OF CORRECTION

PATENT NO. : 4,251,330

DATED : February 17, 1981

INVENTOR(S) : Peter G. Sheasby et al.

It is certified that error appears in the above-identified patent and that said Letters Patent are hereby corrected as shown below:

Col. 6, line 26, "15 minutes" should read --5 minutes-- .

Col. 9, line 33, "consequences" should read --consequence-- .

Signed and Sealed this

*Eleventh* Day of *January 1983*

[SEAL]

*Attest:*

GERALD J. MOSSINGHOFF

*Attesting Officer*

*Commissioner of Patents and Trademarks*